US006427251B1

(12) United States Patent
Leach

(10) Patent No.: US 6,427,251 B1
(45) Date of Patent: Aug. 6, 2002

(54) HEAD TOWEL WRAP

(76) Inventor: Jamie S. Leach, P.O. Box 717, Ada, OK (US) 74820

( * ) Notice: Subject to any disclaimer, the term of this patent is extended or adjusted under 35 U.S.C. 154(b) by 0 days.

(21) Appl. No.: 09/911,646

(22) Filed: Jul. 24, 2001

(51) Int. Cl.[7] ..... A42B 1/12
(52) U.S. Cl. ..... 2/174; 2/68
(58) Field of Search ..... 2/174, 417, 418, 2/171, 202, 204, 207, 208, 67, 68, 205; D2/867, 881, 865; 132/200, 212

(56) References Cited

U.S. PATENT DOCUMENTS

| | | | | | |
|---|---|---|---|---|---|
| 2,694,204 | A | * | 11/1954 | Cross | 2/174 |
| 3,392,737 | A | | 7/1968 | Fefferman | |
| 5,249,308 | A | | 10/1993 | Blume | |
| 5,365,613 | A | | 11/1994 | Henegan | |
| D388,589 | S | * | 1/1998 | Walker | D2/867 |
| 5,708,982 | A | * | 1/1998 | Armani | 2/171 |
| D412,234 | S | * | 7/1999 | Cox | D2/867 |

* cited by examiner

*Primary Examiner*—Gloria M. Hale
*Assistant Examiner*—Tejash Patel

(74) *Attorney, Agent, or Firm*—William S. Dorman

(57) ABSTRACT

A towel wrap for the head of a person whose hair is wet comprising a pouch made of a towel-type fabric, the pouch consisting of a generally rectangular piece of fabric having a horizontal bottom edge approximately four feet in length, a top edge spaced above the bottom edge and including a pair of curved flaps, a pair of spaced vertical side edges connecting from the top edge to the bottom edge to form the generally rectangular piece, the flaps having peaks which are about two feet from the bottom edge and the top edge having a center portion which is about 15 inches from the bottom edge, the bottom edge having a portion about two inches wide which is folded over and stitched back on to the fabric so as to provide a two inch wide belt which extends horizontally between the two side edges, the fabric piece being folded along a vertical center line extending from the center portion of the top edge to the bottom edge, a first piece of adhesive material attached to the belt to one side of the vertical center line, an adhesive tab approximately four to six inches in length and two inches wide being sewn to an end of the belt and having a second piece of adhesive material on an under surface of the tab, the fabric piece, after being folded, being stitched along the curved flaps to connect the same together and to form the pouch, the end of the belt to which the adhesive tab is attached being on the same side of the vertical center line as the first piece of adhesive material.

2 Claims, 5 Drawing Sheets

HEAD TOWEL WRAP

BACKGROUND OF THE INVENTION

1. Field of the Invention

The present invention relates to a towel-like hat, cap or turban to be worn by a woman on or around her hair after the wetting thereof, as occasioned by washing in the shower or treatment at a beauty parlor. More particularly, the present invention relates to a towel-like device which can be fastened to the back of the neck in such a manner as to remain fast on the woman's head while her hair is drying.

2. The Prior Art

In the past, women have used rectangular towels to dry their hair by wrapping the towel around the head, possibly in the form of a turban and holding the towel in place by attempting to tuck one portion under another. It has also been the practice of women to employ electrically operated hair dryers which blow hot air against and through the hair for the purpose of drying the same; however, these hot air dryers can be dangerous and uncomfortable. Further more, the employment of heat, particularly excessive heat, can be damaging to the hair.

A preliminary search was conducted on this invention and the following listed patents were uncovered in the search.

| Pat. No. | Inventor | Date |
|---|---|---|
| 3,392,737 | Fefferman | July 16, 1968 |
| 5,365,613 | Henegan | November 22, 1994 |
| 5,249,308 | Blume | October 5, 1993 |
| 5,708,982 | Armani | January 20, 1998 |
| 5,685,016 | Douglas | November 11, 1997 |
| 5,621,919 | Graham | April 22, 1997 |
| 5,161,260 | Reynolds | November 10, 1992 |
| 5,490,526 | Day | February 13, 1996 |
| 4,790,035 | Whyte | December 13, 1988 |
| 4,031,567 | Planck | June 28, 1977 |
| 3,671,977 | Begnon | June 27, 1972 |
| 3,298,035 | Gobins | January 17, 1967 |
| 2,880,424 | Kalensky | April 7, 1959 |
| 2,817,090 | Toellner | December 24, 1957 |
| 2,694,204 | Cross | November 16, 1954 |
| 2,279,867 | Falk | April 14, 1942 |
| D414,915 | Anderson | October 12, 1999 |
| D412,234 | Cox | July 27, 1999 |
| D388,589 | Walker | January 6, 1998 |
| D381,790 | Harris | August 5, 1997 |

Many of the patents referred to above are pertinent in that they relate to the drying of hair with a towel-like member. However, none of the references disclosed a towel-like member that is constructed in the manner of the present invention. However, Fefferman discloses a pouch like hairnet with pressure sensitive fastening. Henegan discloses a turban type towel with fastenings located on the back neck portion of the user. Blume discloses a pouch type hair towel.

SUMMARY OF THE INVENTION

The present invention involves a towel wrap for the head of a person whose hair is wet and who doesn't wish to have a conventional towel falling off at the least provocation. The towel wrap comprises a pouch made of a towel-type fabric, the pouch consisting of a generally rectangular piece of fabric having a horizontal bottom edge approximately four feet in length. The fabric also includes a top edge spaced above the bottom edge with a pair of curved flaps, and a pair of spaced vertical side edges connecting from the top edge to the bottom edge to form the generally rectangular piece.

The flaps are provided with peaks which are about two feet from the bottom edge. The top edge has a center portion which is about 15 inches from the bottom edge, The bottom edge has a portion about two inches wide which is folded over and stitched back on to the fabric so as to provide a two inch wide belt which extends horizontally between the two side edges. The fabric piece is folded along a vertical center line extending from the center portion of the top edge to the bottom edge. A first piece of adhesive material is attached to the belt to one side of the vertical center line. An adhesive tab approximately four to six inches in length and two inches wide is sewn to an end of the belt and a second piece of adhesive material is attached to the under surface of the tab. The fabric piece, after being folded, is stitched along the curved flaps to connect the same together and to form the pouch. The end of the belt to which the adhesive tab is attached is on the same side of the vertical center line as the first piece of adhesive material.

The towel wrap described above is employed placing the towel wrap over the head of the person while the head is bent forwardly until the belt is against the back of the neck of the person with the first piece of adhesive material being located adjacent the center of the neck and facing outward. Next we pull the left end of the belt around the head and across the forehead. Then we pull on the right end of the belt around the head across the forehead and across the belt previously pulled across, continuing to pull on the right end of the belt around the back of the neck, the resulting pulling of the ends of the belt creating a bag from the remainder of the towel wrap. Thereafter the tab is positioned over the first adhesive strip securing the second piece of adhesive material to the first piece of adhesive material so as to hold the towel wrap on the head.

If desired, the bag can be pulled back over the top of the head and over the back of the neck prior to the securing of the second piece of adhesive material to the first piece of adhesive material, whereby the end of the bag is secured beneath the tab. Also, the bag can be twisted prior to pulling it over the head. Alternatively, the end of the bag can be folded under before securing the same with the tab.

DETAILED DESCRIPTION OF THE PREFERRED EMBODIMENTS

Figure 1:
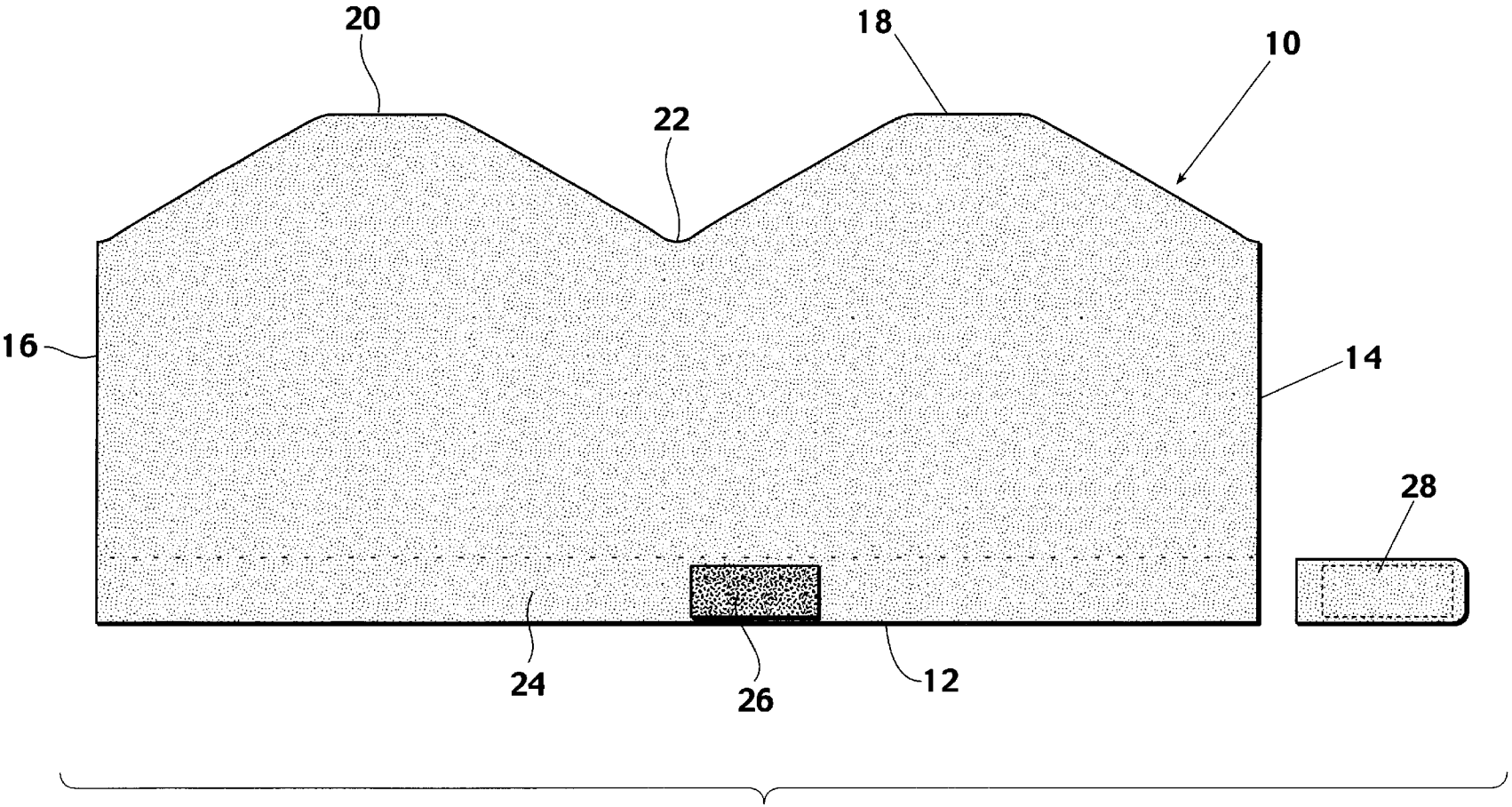
FIG. 1 is a plan view of a piece of terry cloth or similar material, laid flat before folding and stitching and which later becomes the pouch or head towel wrap of the present invention.

Referring now to FIG. 1, there is shown a cloth pattern 10 of terry cloth or similar material of generally rectangular shape, approximately four feet wide and two feet high at the peaks.

The pattern 10 has a bottom edge 12 which is approximately four feet across, a pair of vertical side edges, 14 and 16, which are each about 15 inches high, and a top edge consisting of a pair of curved upper portions or wide flaps at 18 and 20. The peaks of the flaps 18 and 20 are about two feet from the bottom edge 12, The center portion 22, where the two flaps 18 and 20 meet is approximately equal to the vertical sides 14 and 16 and is mainly about 15 inches from the bottom edge 12.

A portion of the bottom edge 12, about two inches wide, is folded over and stitched back on to the pattern so as to provide a two inch wide belt 24 which extends horizontally across the width of the entire device 10. A first piece or strip of adhesive material 26 such as Velcro® (Velcro is a registered trademark of Velcro Industries S.B.) or other adhesive material is positioned slightly to the right of the center of the belt 24. An adhesive tab 28 approximately four to six inches in length and two inches wide (and having a second piece of adhesive material such as Velcro® on its underside) is sewn to the right hand end of the belt 24.

Figure 3:
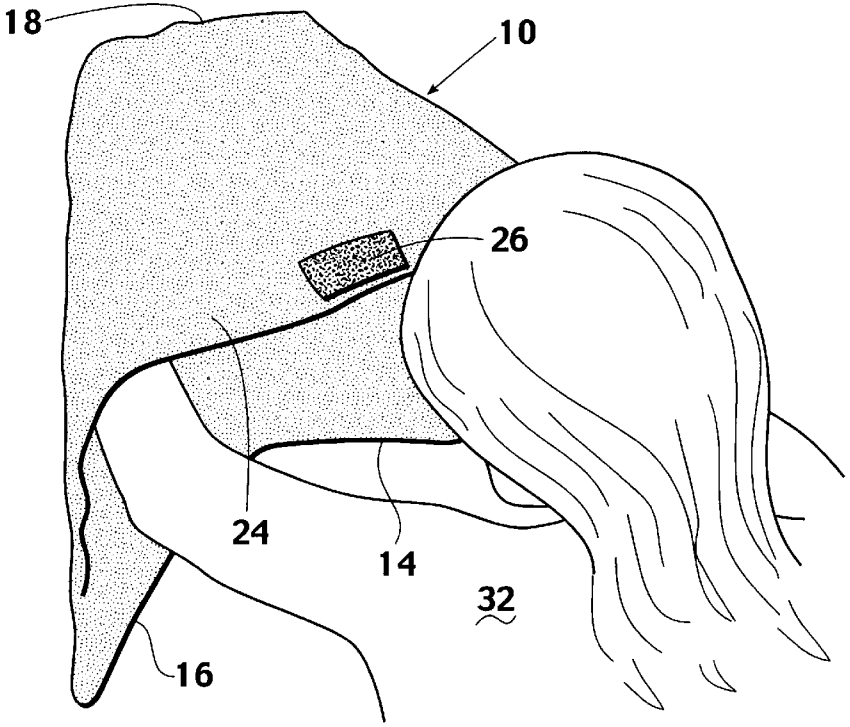
FIG. 3 is a perspective of a woman holding the pouch of the present invention with her arms upwardly and forwardly extended prior to placement of the pouch over her head.
Figure 2:
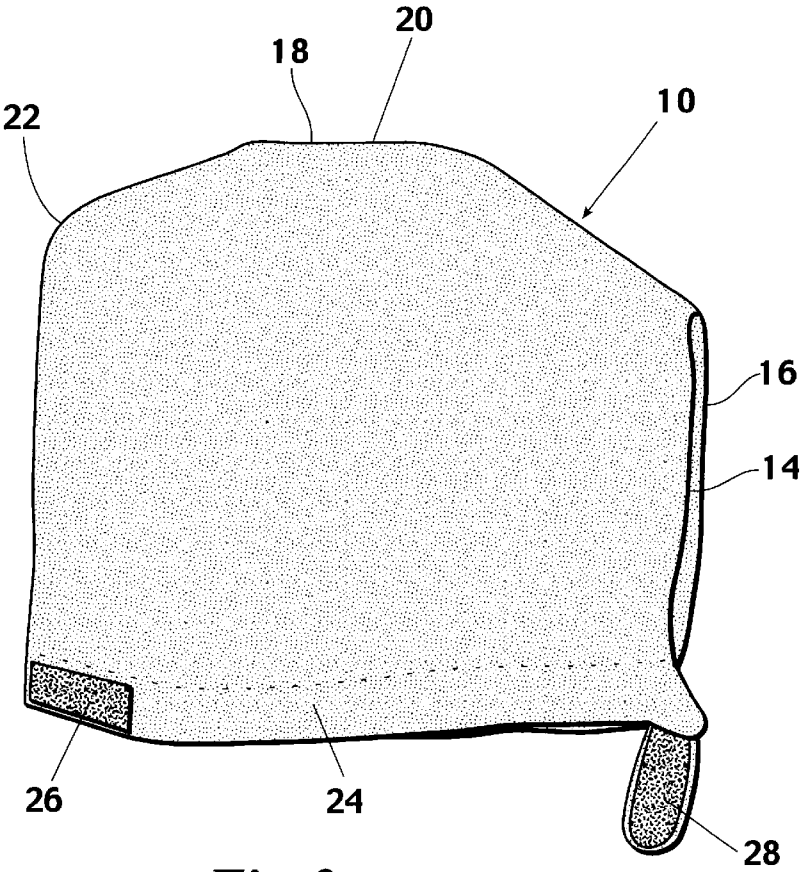
FIG. 2 is a plan view of the completed pouch of the present invention fully sewn and prior to placement on the head of a woman.
Figure 4:
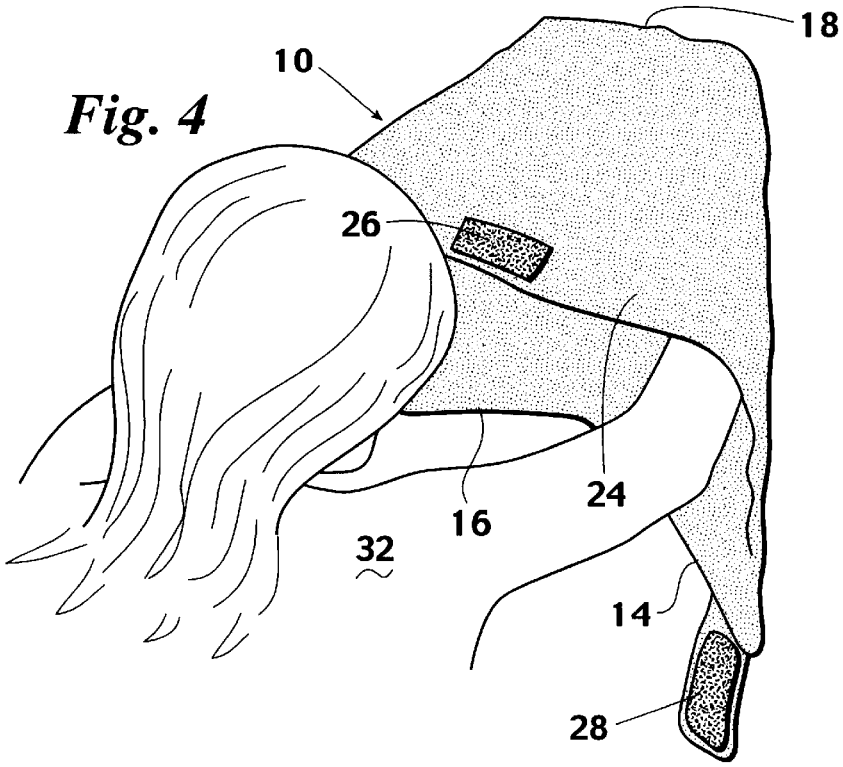
FIG. 4 is a perspective view similar to FIG. 3 showing the same woman holding the same pouch but from a different perspective angle so as to reveal the adhesive tab hanging from the right side of the pouch.
Figure 5:
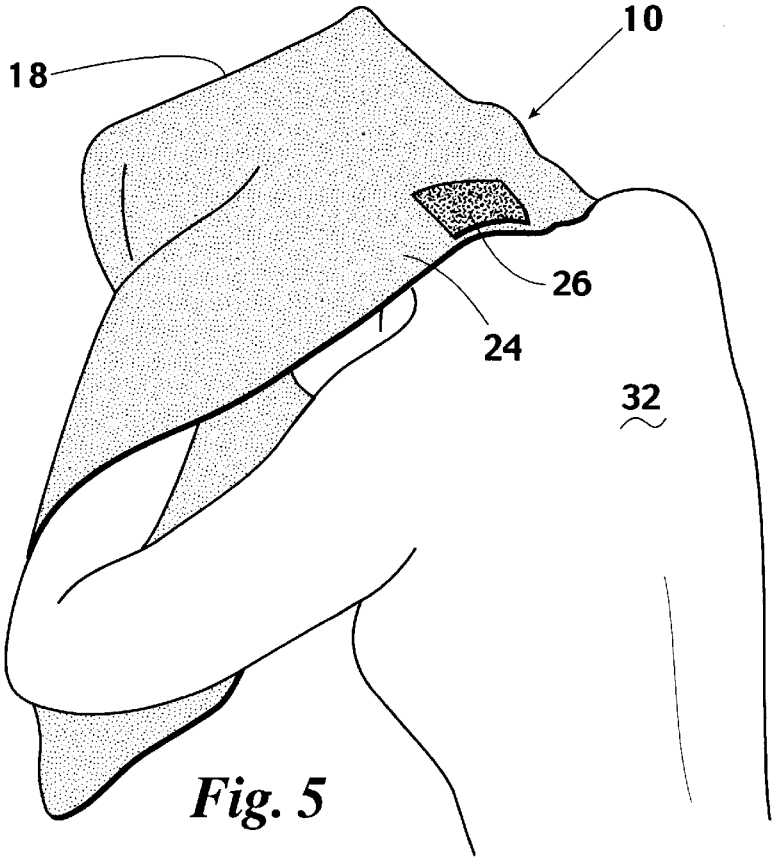
FIG. 5 is a perspective of a woman placing the towel-like pouch of the present invention over her head and around the back of her neck with one adhesive strip being exposed at the back of the neck just to one side of the center.

At this juncture, the pattern 10 is folded along the vertical center line 22 such that the first adhesive piece 26 is on the outside of the folded device. Thereafter, the curved portions or flaps 18 and 20 are sewn together so as to form a pouch which is the folded form of the pattern 10. The side edges 14 and 16, however, are not sewn, so that the device 10 appears to be an open pouch as shown in FIGS. 3 and 4, which a woman 32 can place over her head so that the adhesive strip 26 is at the back of her neck facing outwardly of her body as shown in FIG. 5. It should be mentioned that the entire form 10 is treated with a type of stitching known as surging along the entire periphery to prevent unraveling of the material. Surging can also be used on some of the other stitches if desired.

Figure 6:
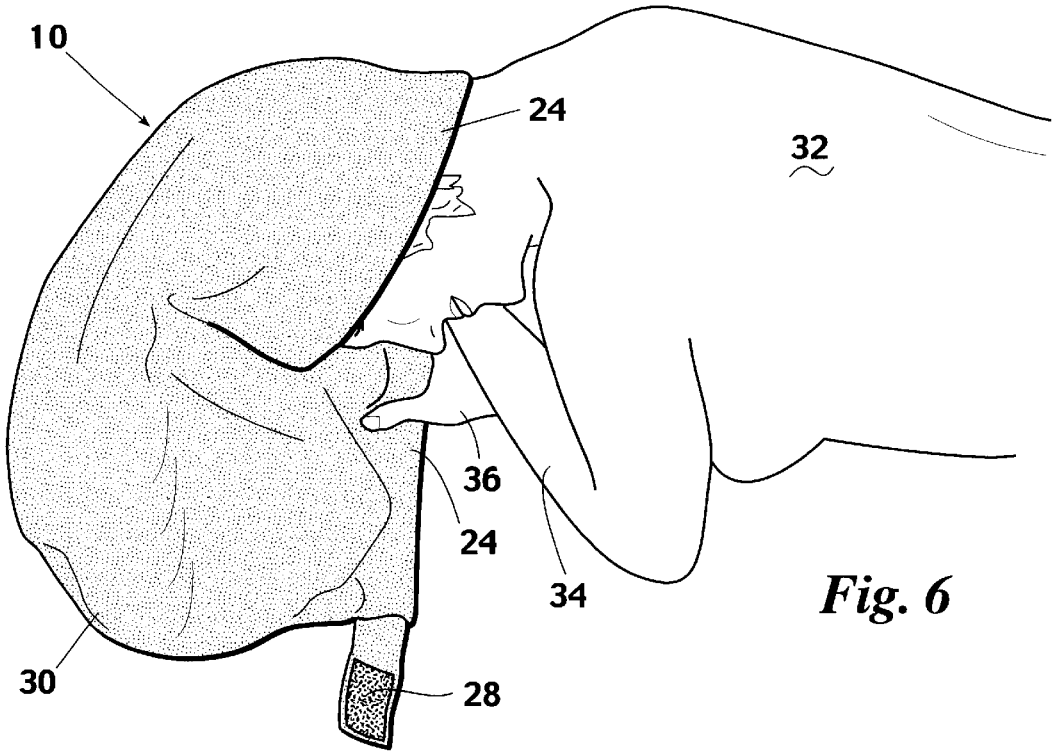
FIG. 6 is a transitional view from FIG. 5 showing the woman having pulled the belt from the left side of the towel across her forehead with her left hand, followed by the pulling of the right hand end of the belt with her right hand so as to fold the right hand belt end over the folded left hand belt end and across the forehead with the adhesive tab following the folding of the last mentioned belt piece.
Figure 7:
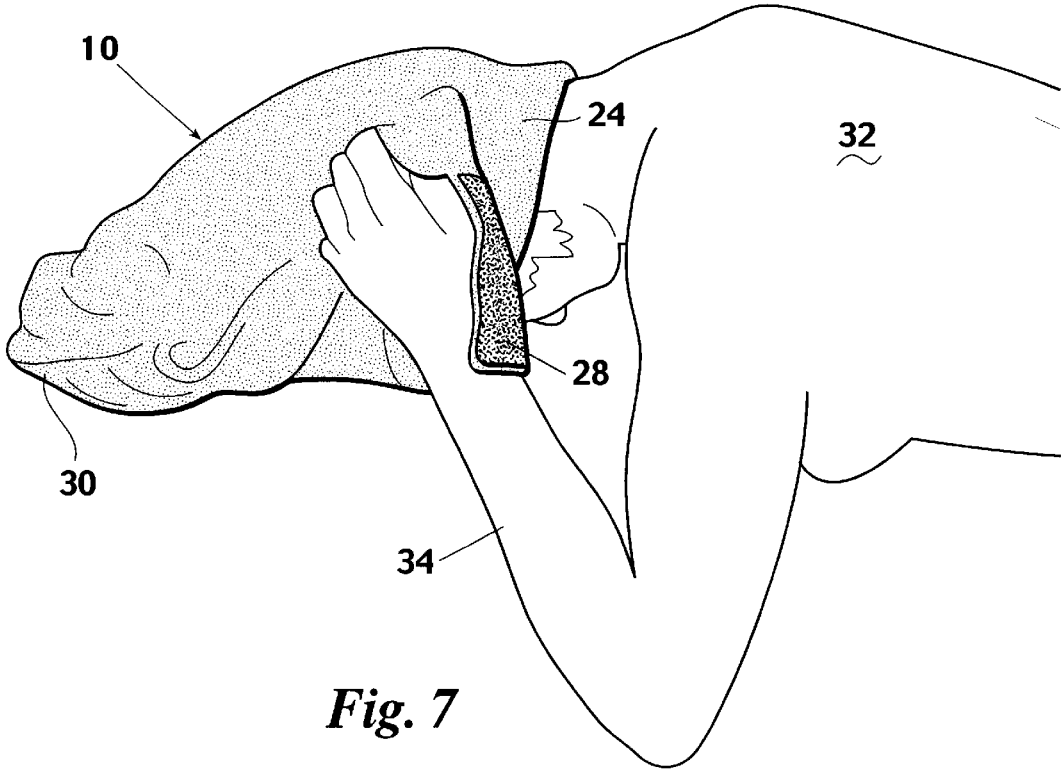
FIG. 7 is a view similar to FIG. 6 but showing the next progression where the woman has grabbed the front part of the towel and twisted it with her right hand while holding on to the adhesive tab with her left hand.

Turning now to consideration of FIG. 6, the woman 32 with her left hand 34 will take the left hand end of the belt portion 24 and fold it over the front of her face so that the belt 24 goes across her forehead. After doing this, she then takes the right hand end of the belt 24 with her right hand 36 and folds it towards the left over the folded portion of belt 24 from the left side, so that the right hand end of the belt 24 also goes across the forehead crossing in the center over the previously pulled left hand portion of the belt 24. At this point, the woman will switch her left hand to the portion that has been folded towards the right as in FIG. 7 so she can grab the end of the belt 24 which now includes the tab 28 containing the Adhesive strip.

At this point, a number of different procedures can be employed, all of which would advantageously utilize the pouch 10 and its features. For example, the Adhesive tab 28 can be applied directly over the Adhesive piece 20 with the remaining bag portion 30 hanging down in the front, after which the woman can just flip the rest of the towel 30 so that it hangs over the back of her neck.

Figure 8:
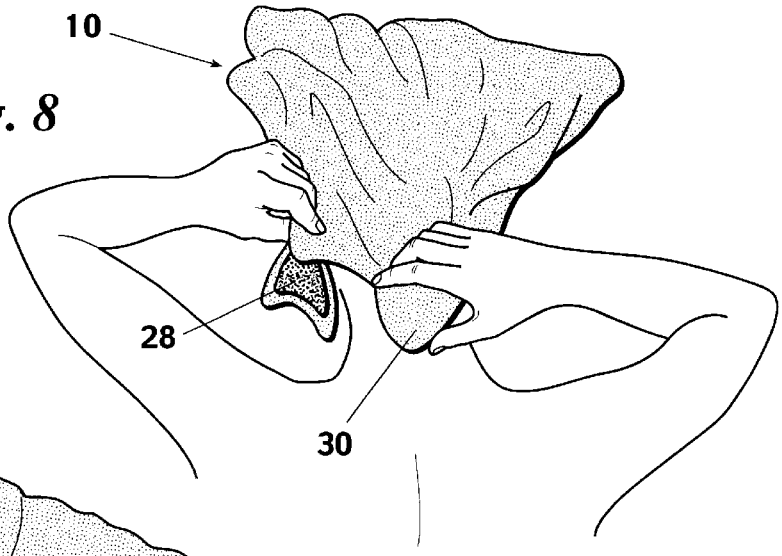
FIG. 8 is a perspective view showing the next progression from FIG. 7 where the woman is holding down on the end of the drawn-back bag prior to closing the adhesive tab over the adhesive strip.
Figure 9:
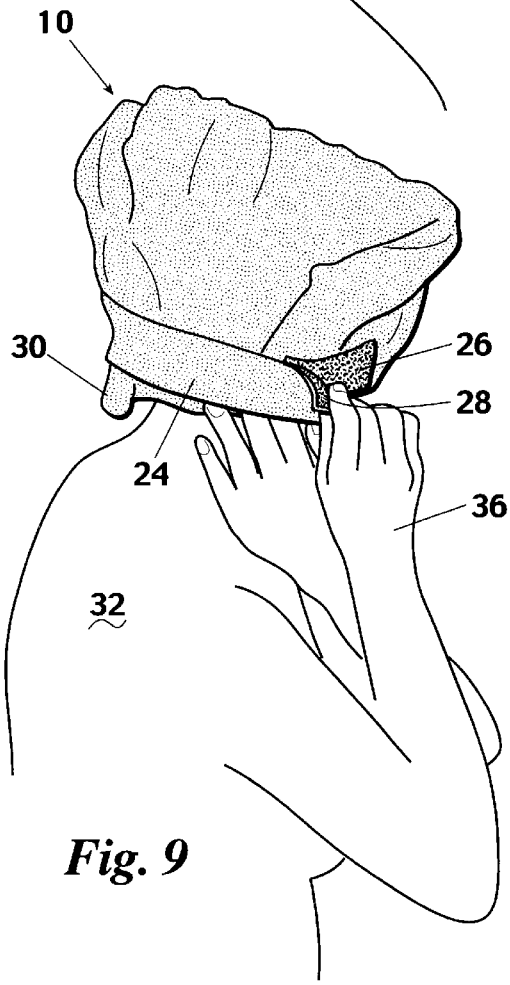
FIG. 9 is a transitional view from the last Figure showing the woman placing the folded back portion of the front of the towel over the back of her neck and the placement of the adhesive tab, now on the right, over the downwardly pulled portion of the front of the towel with the adhesive portions being placed in engagement with each other.

Preferably, however, as shown in FIG. 8, the woman flips the bag portion 30 of the towel which was hanging down in front so that it hangs down back over the back of her neck and thereafter, as shown in FIG. 8, she places the tab 28 over this pulled back portion and into engagement with the tab 20. If desired, the bag portion 30 can be twisted before placing the tab 28 over the strip 20.

Figure 10:
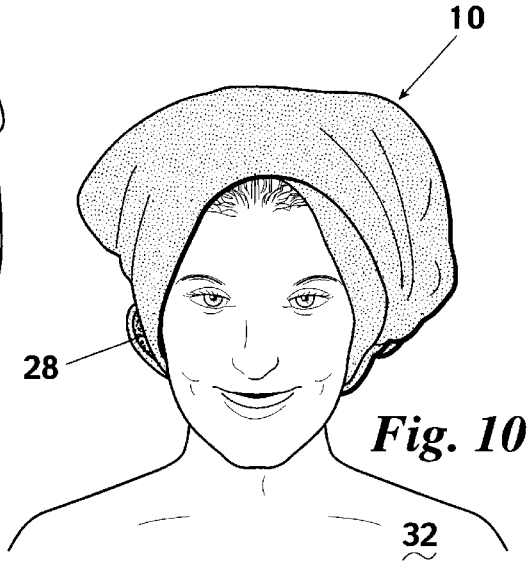
FIG. 10 is a perspective view of the woman and towel wrap from the front.

In FIG. 10, which is a view from the front, the towel wrap is fully secured in place and the wearer is free to engage in other activities without fear of losing the towel wrap.

There are numerous ways in which the device of the present invention can be used on a woman's head. The bag 30 can be flipped directly back without any twists and then folded under before securing with the Adhesive tabs. Finally, the bag can be just wrapped around the hair, the two tabs can be brought into engagement with each other and the bag then allowed to hang over the outside of the Adhesive attachment.

The dimensions of the cloth pattern 10 (a.k.a. towel wrap)are not considered to be critical in the broad sense. However, from a practical standpoint these dimensions represent what a towel designer should strive for when considering the average size of the human head and the fact that the wearer will be taking two opposite strips or ends, represented by the belt 24, and will be folding them from the back of the neck, crossing at the forehead, the portion pulled from the right and containing the adhesive tab crossing over the portion pulled from the left and holding it in place, continued wrapping of the right hand portion to the left, while switching hands, and around the back of the neck until the adhesive tab 28 can engage the adhesive strip 26 located at the back of the neck towards the area of the right ear. In effect, we have a human head which is approximately two feet in circumference and we are wrapping the head with a double thickness of towel (which is known to be somewhat stretchable) which means that the length of the belt 24 should be about four feet, give or take a few inches, or twice the circumference of the human head. Therefore, for children, the dimensions of the towel wrap can be made smaller, consistent with the intended use as described above.

Women have wrapped their heads with towels for years and have experienced varying degrees of success in preventing the towel from falling off. The important consideration for this invention is that the wearer can wrap her head with a towel-like device and fasten it in place without having to worry about it falling off. With the present invention, the wearer can do house work, read a book or look after the children while her hair is drying. The description of the tab 28 being on the left is not critical; obviously, the tab could be on the left, in which case the wrapping would be reversed from that described.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modification are encompassed within the spirit of this invention as defined by the appended claims.

What is claimed is:

1. A towel wrap for the head of a person comprising an open ended pouch made of a towel type fabric and having a height approximately equal to a circumference of the head;

the pouch being attached to a belt having a two-inch width that extends horizontally at a bottom edge portion thereof;

the bottom edge portion extends approximately twice the circumference of the head;

a first piece of hook and loop material is attached to the belt at an outer central surface thereof;

a tab that is approximately four to six inches in length and two inches in width is sewn to one end of the belt;

a second piece of hook and loop material is positioned underneath the tab;

the towel wrap is adjustably positioned about the head with the second piece being releasably attached to the central surface of the first piece.

2. A towel wrap for the head of a person whose hair is wet comprising a pouch made of a towel type fabric, the pouch consists of a generally rectangular piece of fabric having a horizontal bottom edge that is approximately four feet in length;

a top edge spaced above the bottom edge includes a pair of curved flaps;

a pair of spaced vertical side edges are connected from the top edge to the bottom edge, which forms the generally rectangular piece;

the flaps include peaks that are at least two feet from the bottom edge and the top edge has a center portion therebetween, which is at least 15 inches from the bottom edge;

the bottom edge has a portion that is at least two inches wide being folded over and stitched back onto the fabric, so as to provide a belt having a two-inch width, which extends horizontally between the two side edges;

the fabric piece folded along a vertical centerline extends from the center portion of the top edge to the bottom edge;

a first piece of hook and loop material is attached to the belt generally at one side of the vertical center line;

a tab approximately four to six inches in length and two inches in width is sewn to an end of the belt;

the fabric piece after being folded is sewn together to form the pouch, the end of the belt having hook and loop tab is positioned on same side of the vertical center line as the first piece of hook and loop material, so that the towel wrap is releasably attached about the head.

* * * * *